United States Patent [19]

Ferri

[11] 4,167,904

[45] Sep. 18, 1979

[54] SHOT COMPRESSOR DEVICES AND METHOD THEREFOR

[76] Inventor: Bernard L. Ferri, 2125 Lynwood La., Pueblo, Colo. 81005

[21] Appl. No.: 833,478

[22] Filed: Sep. 15, 1977

[51] Int. Cl.[2] ..... F42B 7/08

[52] U.S. Cl. ..... 102/42 C

[58] Field of Search ..... 102/42 R, 42 C, 43 C, 102/95

[56] References Cited

U.S. PATENT DOCUMENTS

| | | | |
|---|---|---|---|
| 875,762 | 1/1908 | Winans et al. | 102/42 R |
| 1,352,938 | 9/1920 | Blair | 102/42 R |
| 3,121,391 | 2/1964 | Young | 102/42 C |
| 3,208,382 | 9/1965 | Foote et al. | 102/42 C |
| 3,215,076 | 11/1965 | Foote et al. | 102/42 C |
| 3,289,586 | 12/1966 | Horn et al. | 102/42 C |

FOREIGN PATENT DOCUMENTS

| | | | |
|---|---|---|---|
| 461417 | 10/1913 | France | 102/42 R |
| 35061 | 1/1928 | France | 102/95 |
| 427055 | 11/1947 | Italy | 102/42 C |

*Primary Examiner*—Verlin R. Pendegrass
*Attorney, Agent, or Firm*—Burton & Dorr

[57] ABSTRACT

A shot compressor device for use in a shotgun cartridge containing shot wherein in a first embodiment or wad includes an upstanding tube centrally disposed on the bottom wall and parallel to the side walls of the cartridge with the shot being disposed in an area defined between the tube and the side walls above the bottom wall and wherein the tube is capable of being collapsed and compressed inwardly when the cartridge is fired by a shotgun. A collar for use in a shotgun cartridge containing shot having a cylinder integral with the base of the tube with an outer diameter substantially equal to the inside diameter of the cartridge wherein the cylinder is disposed between the shot and the cartridge and a plurality of flaps radially extending inwardly from the upper edge of the cylinder with each of the flaps being oriented above the upper surface of the shot wherein the flaps cooperate to prevent the shot from abrading the interior surface of a shotgun when the cartridge is fired. In a second embodiment the upstanding tube, alone or mounted on a base, is used in the shot substantially central in the cartridge. In a third embodiment the upstanding tube and the collar are separate components with the collar extending only partially down the side walls of the cartridge.

A method for directing the shot in a radially inward direction as the shot is travelling through the barrel of a shotgun.

18 Claims, 18 Drawing Figures

SHOT COMPRESSOR DEVICES AND METHOD THEREFOR

DISCUSSION OF THE PRIOR ART

Field of the Invention

This invention relates to the field of shotgun cartridges and more specifically to shotgun cartridges adapted to carry steel shot.

Background of the Invention

Traditionally shotgun cartridges have utilized lead shot for gunning game birds such as water fowl. However, new government regulations have banned the use of lead shot in gunning water fowl due to the large number of birds dying of ingestation of lead shot. The law now requires a non-toxic substitute for lead shot for all water fowl gunning.

One such non-toxic substitute for lead shot is what is becoming termed "soft steel" shot. However, the enactment of the mandatory law forbidding the use of lead shot has been substantially delayed due to severe technological problems encountered through the use of steel shot. The primary problem relates to the damage steel shot causes to existing shotguns. Steel shot scratches and wears the shotgun barrel, especially in the choke area. Enlargement of the choke area caused by shot wear defeats the purpose of the choke (which is to restrict spreading) by causing spreading of the shot. The use of steel shot has even caused some chokes to shoot out creating a dangerous condition for the user of the gun. Most importantly is the consumer dissatisfaction with steel shot since the owner of an expensive shotgun becomes extremely unhappy even if the only result from the use of steel shot is a superficial scratch.

Modern shotguns are being designed to have harder steel barrels in order to compensate for the abrasive effect of steel shot. Even so, most manufacturers of steel shot cartridges are advising against the use of steel shot in "doubles" or "over and under" shotguns due to the thinner walls of the double barrels.

The use of steel shot results in a better pattern since it does not deform upon exiting the gun. This is a major advantage over lead shot since the lead shot around the periphery of the cartridge hitting the barrel becomes deformed and encounters greater wind turbulance as it passes through the air. Steel, on the other hand, does not deform upon exiting and maintains a tighter pattern. Steel shot, however, being of less specific gravity than lead (7.86 versus 11.34) does not maintain the velocity in impact of lead.

To prevent the choke and barrel damage, one manufacturer, Remington, has developed a thick plastic shot protector for the steel shot column to pass through the choke without damage thereto. Another manufacturer, Winchester, utilizes a high density powdered polyethylene material in the shot column, as a filler, comparable to that presently used in buckshot loadings to prevent deformation of the shot. Winchester also uses an "overshot wad" with an "off-bounce" portion. Even with these devices, due to the dangerous conditions being encountered through use of steel shot, it is being advised that one never attempt to reload with steel shot. The above general discussion has been generated from the following references:

Bob Overton, Outdoor World, Pueblo Star-Journal, Feb. 20, 1977

Sports Afield with Rod and Gun, August 1976 (Page 17)

Outdoor Life, December, 1972 (page 47)

The Mystery of Choke, Outdoor Life, March, 1974 (Page 16)

Lyman "Shotshell Handbook", 1969 (Page 60)

Point Blank, Guns, April, 1977

Will Steel Shot Work In Your Gun?, Outdoor Life, August, 1977

In order to avoid all of the above problems pertaining to barrel and choke wear and damage and in order to provide a device for use by reloaders, the present invention encases the steel shot in a thin plastic sleeve wad having an upper enclosing flap and an upstanding hollow post disposed in the center of the steel shot. When the shot leaves the barrel of the gun, the plastic sleeve wad of the present invention accompanies the shot and, at the choke, the steel shot compresses inwardly collapsing the hollow post so that in cooperation with the plastic sleeve, no barrel or choke abrasion occurs. The collapsing of the hollow post centrally disposed to the shot causes the shot to exit from the gun in a very tight pattern which increases the number of shot in the pattern over prior approaches. Furthermore, the present invention is adaptable for reloading with lead shot in order to also obtain the same intensity in pattern hitting substantially eliminating lead deformation.

Prior to this application, the inventor conducted a patentability search to ascertain any comparable prior art approaches. The results of that patentability search resulted in the following patents:

| Inventor | Patent No. | Date |
|---|---|---|
| (Italian) | 427,055 | Nov. 12, 1947 |
| (French) | 510,386 | Sept. 4, 1920 |
| Winans | 875,762 | Jan. 7, 1908 |
| Edwards | 2,125,224 | July 26, 1938 |
| Foote et al | 3,217,648 | Nov. 16, 1965 |
| Comerford | 3,266,421 | Aug. 16, 1966 |
| Comerford | 3,269,311 | Aug. 30, 1966 |
| Herter | 3,279,375 | Oct. 18, 1966 |
| Moehlman et al | 3,669,023 | June 13, 1972 |
| McCaffrey et al | 3,670,650 | June 20, 1972 |
| Anderson | 3,796,157 | March 12, 1974 |

The 1908 patent issued to Winans et al. teaches the use of a centered upstanding post with either a closed or an open top as best shown in FIGS. 1, 2 and 4. A variety of configurations are shown in FIGS. 2–7. The Winans et al approach specifically relates to "spreading" the shot upon firing thereof. Upon emerging from the gun, the shot is caused to spread. By lengthening the post, the spreading of the shot is increased.

The 1947 Italian patent (427,055) and the 1920 French Patent No. (510,386) show cylindrically shaped center posts which are hollow. Specifically, the Italian approach shows the upstanding center post to be affixed to the shell casing. On the other hand, the French approach teaches the use of a shot pocket portion (designated as 1) disposed between the shot and the shell casing.

The Italian patent issued to Roma relates primarily to a grenade/bullet—i.e., a projectile device that explodes which is small in shape. The cylinder 3, as shown in FIG. 1, is connected to a box which contains a charge of explosive. While in flight, the charge explodes causing great expansion to occur in the cylinder 3 and causing the shot to explode outwardly as in a grenade.

The French patent issued to Avond, like the present invention, is an appratus designed to improve the range and grouping of shot or pellets. This is accomplished by having a hollow cylindrical center 5 having disposed on the interior thereof three small fins 6 shaped as propellers. When the Avond shell emerges from the gun barrel, the outer cylinder 1 is maintained around the shot for a greater distance and air is directed by the conical cap 9 into the internal passageway defined by cylinder 5. The propellers 6 serve to rotate the entire assemblage. Eventually, the outer casing separates from the shot and falls to the earth. From the teachings of the Avond approach, it is essential that the interior cylinder 5 maintains its cylindrical shape so that the propellers 6 can cause the assemblage to rotate after leaving the barrel of the gun. To accomplish this, the rings 3 allow the shot to expand outwardly against the barrel of the gun upon exiting therefrom.

The 1972 patent to McCaffrey et al teaches the use of a mid-wad having a central cylindrically shaped post which is hollow. Upon ignition of the powder, the side walls and the center post collapse to absorb shock thereby minimizing recoil and increasing velocity of the shot as set forth in the table. The purpose of the McCaffrey et al approach is to maximize accuracy in distance while minimizing recoil.

The 1974 patent issued to Anderson, as shown in FIGS. 3 and 5 utilizes an upstanding cylindrically shaped hollow center post in order to provide defined regions containing shot of differing diameters. As shown in FIG. 1, the central region contains shell of larger diameter than the peripheral region.

The 1938 patent issued to Edwards discloses the provision of a pocket portion 15 which is used around the shot and inside the shell casing to prevent balling and barrel scrubbing. The express purpose is to increase velocity and, therefore, distance of the fired shot. Edwards discloses the provision of a plurality of end portions (designated as 16).

The 1972 patent issued to Moehlman et al also teaches the use of a one-piece plastic shot protector as best illustrated in FIG. 2 having end portions (designated 14) enclosing the shot as shown in FIG. 4. The Moehlman et al approach would appear to be an improvement over the Edwards approach in that both seek to prevent barrel abrasion and to increase velocity of the exploded shot.

The 1965 patent issued to Foote et al also uses a liner to prevent barrel abrasion.

The U.S. Pat. Nos. issued to Comerford (3,266,421 and 3,269,311) and to Herter are not as close as the above prior art patents and will not be further discussed.

After careful analysis of the above prior art and the recently encountered problems and disadvantages surrounding steel shot, the present invention seeks, through a novel approach, to substantially minimize those problems. Specifically, unlike the Avond approach which also achieves improved range and grouping of shot, the central hollow upstanding member collapses upon exit from the gun rather than maintaining its shape. Unlike the Winans et al approach, all of the embodiments shown therein relate to a device which has a center post that contracts as the cartridge leaves the gun, but expands in order to spread the shot. Winans et al teaches the use of a center post to prevent the shot from crossing during the travel through the gun's barrel and to contract sufficiently so that upon exit from the gun, the post expands causing the shot to be spread. Furthermore, the force of recoil and the temperature of the barrel are reduced through use of the compressor devices of the present invention.

SUMMARY OF THE INVENTION

The invention relates to a shot compressor for use in a shotgun cartridge wherein the compressor comprises an upstanding tube substantially centrally disposed internally of a shotgun cartridge with the shot disposed around the tube and wherein the tube compresses a predetermined volume when the cartridge is fired through the shotgun thereby substantially minimizing barrel abrasion and effectuating greater distance with a tighter pattern of shot. In a modification of the above, the upstanding tube is connected to a base mounted above the powder but below the shot and the base in turn is connected to cylindrically shaped side walls disposed between the shot in the interior walls of the shotgun cartridge. In yet a further modification to the above, a plurality of inwardly directed flaps are disposed on the end of the side walls opposing the bottom wall wherein the flaps are capable of restraining the shot in the defined area as the compressor travels through the barrel of the shotgun upon firing. In still another modification, the upstanding tube can be in releasable engagement with the base. In yet a further modification the side walls comprise a plurality of vertical segments having open ended slits formed between each pair of the segments and may have a thin membrane disposed the entire length of the segment and integral therewith.

The invention relates to, in the separate embodiment, a collar for use in a shotgun cartridge contianing shot. The collar includes a cylinder with an outer diameter substantially equal to the inner diameter of the cartridge wherein the cylinder is disposed between the shot and the cartridge and a plurality of flaps radially extend inwardly from the upper edge of the cylinder with each of the flaps being oriented above the upper surface of the shot and wherein each flap cooperates to prevent the shot from abrading the interior surface of the barrel of a shotgun when the cartridge is fired.

A method for reducing barrel abrasion in a shotgun is disclosed by directing the steel shot in movement in a radially inward direction towards a longitudinal center position as the shot travels through the barrel of the shotgun.

OBJECTS OF THE INVENTION

It is an object of this invention to provide a new shot compressor for use in a shotgun cartridge containing shot to prevent barrel abrasion.

It is a further object of the present invention to provide a new and novel shot compressor for use in a shotgun cartridge containing shot which increases the distance and pattern tightness of the shot.

It is still a further object of the present invention to provide a new and novel shot compressor for use in a shotgun cartridge containing steel shot which can be reloaded.

It is still a further object of the present invention to provide a new and novel shot compressor for use in a shotgun cartridge containing shot wherein the shot compressor includes means substantially centrally disposed internally of the cartridge with said shot disposed therearound for collapsing a predetermined volume when said cartridge is fired by the shotgun.

It is still a further object of the present invention to provide a new and novel shot compressor for use in a shotgun cartridge containing a wad having cylindrically shaped side walls disposed between the shot and the interior walls of the cartridge, a bottom wall integral with said side walls oriented under the shot, and an unstanding tube centrally disposed on the bottom wall parallel to the side walls wherein the shot is disposed in the area defined between the tube and the side walls above the bottom wall and is capable of compressing inwardly when the cartridge is fired by the shotgun.

It is still a further object of the present invention to provide a new and novel shot compressor for use in a shotgun cartridge containing shot wherein a wad includes a bottom circular wall under the shot, a plurality of vertical segments integral at one end to the bottom wall, each of the segments terminating in an inwardly directed flap on the end of the segment opposing the bottom wall wherein each segment separates the shot from the interior surface of the cartridge, and an upstanding tube cetnrally disposed on the bottom wall wherein the shot is uniformly placed in the area defined between the segments and the tube and the tube is further capable of being collapsed inwardly when the cartridge travels through the barrel of a shotgun upon firing.

It is still a further object of the present invention to provide a new and novel shot compressor for use in a shotgun cartridge containing shot wherein a wad includes a bottom circular wall under the shot, a plurality of vertical segments separating the shot from the interior surface of the cartridge, each segment being integral at one end to the bottom wall and every pair of the segments cooperating to form slits between each pair, and wherein each segment terminates in an inwardly directed flap on the end of the segment opposing the bottom wall, an upstanding hollow tube centrally disposed on the bottom wall, said shot being uniformly placed in the area defined between said segments and said tubes, and means on the end of the tube opposing the bottom wall for preventing the shot from entering the hollow portion of the tube.

It is still a further object of the present invention to provide a new and novel shot compressor for use in a shotgun cartridge containing shot wherein the compressor contains a base engaging the bottom region of the cartridge below said shot and a hollow tube extending upwardly from the center of the base through the shot, the tube being capable of compressing as the cartridge is fired outwardly through the barrel of the shotgun.

It is still a further object of the present invention to provide a new and novel shot compressor for use in a shotgun cartridge containing shot wherein the compressor includes a base for engaging the bottom region of the cartridge below the shot, the base having a plurality of radially extending legs supported on a circular platform, each of the legs extending outwardly from the center of the base, a hollow tube extending upwardly from the center of the base through the shot being capable of compressing as the cartridge is fired outwardly through the barrel of a shotgun, and a means on the end of the tube opposing the base for preventing the shot from entering the hollow portion of the tube.

It is a further object of the present invention to provide a new and novel collar for use in a shotgun cartridge containing shot having a cylinder with an outer diameter substantially equal to the inside diameter of the cartridge wherein the cylinder is disposed between the shot and the cartridge and a plurality of flaps radially extending inwardly from the upper edge of the cylinder, each of the flaps being oriented above the upper surface of the shot and the flaps cooperating to prevent the shot from abrading the interior surface of the barrel of a shotgun when the cartridge is fired.

It is a further object of the present invention to provide a new and novel device for substantially preventing barrel abrasion in the shotgun caused by shot from a fired cartridge wherein the device comprises a hollow tube substantially centrally disposed in the interior of the shot terminating at the end nearest the powder in the cartridge in a base substantially perpendicular to the tube wherein the tube is capable of being compressed when the cartridge is fired through the barrel of the shotgun and having a collar with an outer diameter substantially equal to the inner diameter of the cartridge and being disposed between the cartridge and the shot so that the collar terminates in a plurality of inwardly directed flaps oriented over the upper surface of the shot.

It is a further object of the present invention to provide a new and novel method for reducing barrel abrasion in a shotgun by moving the steel shot in a radially inward direction towards a longitudinal center position as the shot travels through the barrel of a shotgun.

DETAILED SPECIFICATION

Figure 1:
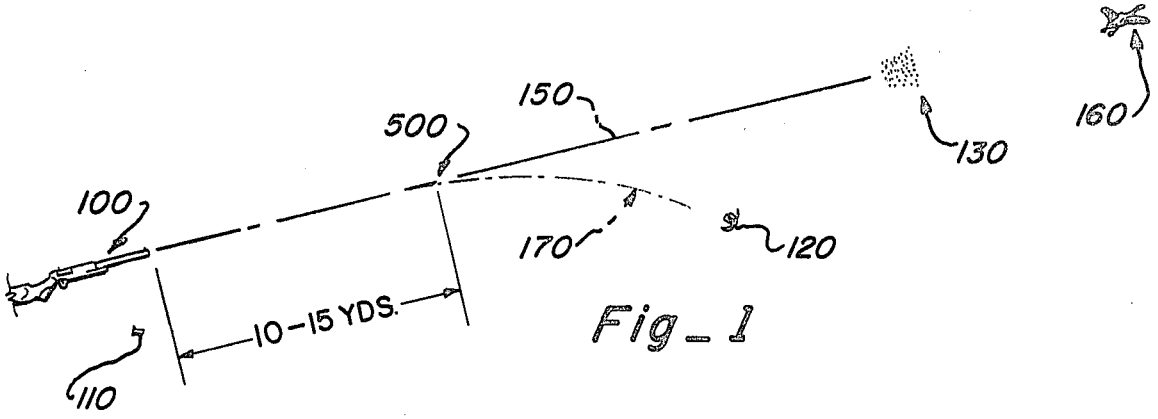
FIG. 1 is an illustration of a shotgun using the shot compressor of the present invention.

In FIG. 1, a gun 100 is shown firing a shotgun shell 110 containing the shot compressor 120 of the present invention and shot 130. The gun 100 is aimed in the direction 150 of a bird 160. The gun is then fired and the shell 110 is discharged from the gun as shown. The shot compressor 120 containing the shot 130 travels for a given distance before being separated from the shot 30 (an example of 10–15 yards is shown, but varies according to amount of powder, type of shot, etc.). The shot compressor 120 of the present invention then follows a new trajectory 170 to the ground. The shot then continues along the path 150 hitting the bird 160 which is located some 40 yards from the gun.

Figure 2:
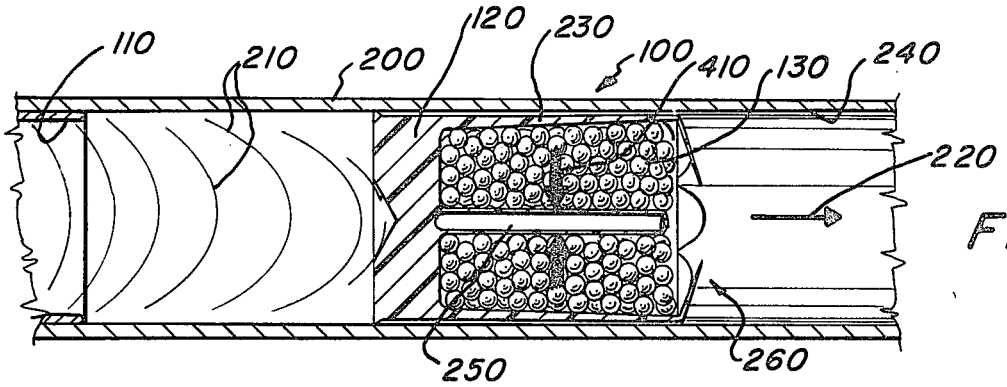
FIG. 2 is a cross-sectional view of the shot compressor of the present invention leaving the shell while traveling through the barrel.

The barrel 200 of the gun 100 is shown in FIG. 2 in cross-sectional arrangement to illustrate the travel of the shot compressor 120 of the present invention through the barrel 200 of the gun 100. As shown in FIG. 2, the shot compressor 120 becomes separated from the shell 110 upon the explosion of the powder. The explosion force is shown diagrammatically by force lines 210. The force of the explosion 210 causes the shot compressor 120 to travel through the barrel 200 in the direction of arrow 220.

As will be more subsequently discussed in detail, the shot compressor 120 of the present invention, in one embodiment, includes a cylindrical outer wall 230 separating the shot 130 from abrading the interior surface 240 of the barrel 200 as the shot compressor 120 and shot 130 travel through the barrel 200. Furthermore, the shot compressor 120 of the present invention also includes a hollow substantially cylindrical center tube 250 around which the shot 130 is placed, and also includes a plurality of flaps 260 inwardly bent from the outer cylindrical wall 230 to restrain the shot 130 upwardly of the shot compressor 120 as the shot compressor 120 travels in the direction of arrow 220. It is readily seen that no abrasion of the barrel 200 occurs when the shot compressor 120 and the shot 130 travels in the orientation shown in FIG. 2 through the barrel since the cylindrical walls separate the shot from the barrel.

Figure 3:
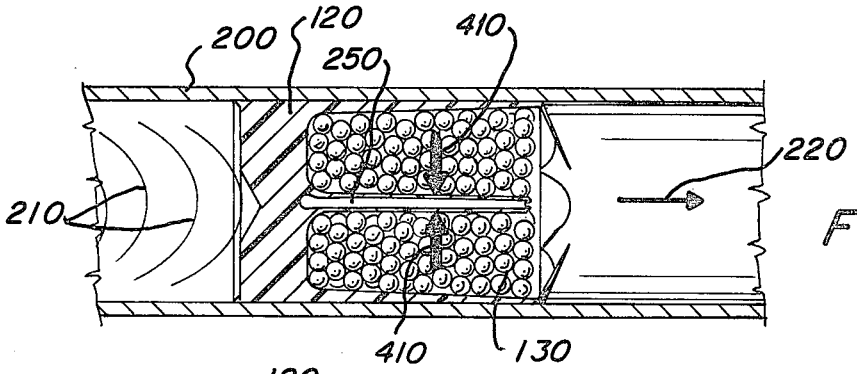
FIG. 3 is a cross-sectional view of the shot compressor of the present invention as it travels through the barrel of a shotgun.

As the travelling shot compressor 120 in the direction of arrow 220 continues its path through the barrel 200 as shown in FIG. 3 near the end of the barrel, the diameter of the barrel slightly decreases. When this occurs, the cylindrically hollow tube 250 also undergoes a corresponding decrease in diameter. The same effect occurs in FIG. 4 as the shot compressor travels through a choke 400 which is generally manufactured or affixed on to the end of the barrel 200. As the shot compressor 120 and the shot 130 travel through the choke 400, the choke 400 which is of even further decreased diameter causes the hollow cylindrical tube 250 to substantially fully compress, depending on the type of choke used. It is to be noted, that throughout the shot compressor's travel through the barrel 200, and choke 400, no separation of the shot and compressor occurs. This fully prevents the shot 130 from abrading the surface of the gun barrel. Since the compression which normally is taken up by the malleability of lead shot, is taken up by the hollow tube 250 when steel shot 130 is used. Thus, barrel wear through use of the hollow center tube 250 and the enclosing flaps 260 substantially eliminates the risk of barrel wear and abrasion due to abrading shot. Furthermore, as the shot exits from the gun 100, the force of the collapsing shot indicated by arrows 410 tends to keep the shot exiting the gun in a much tighter pattern than in conventional approaches. When used with lead shot, deformation of the lead is prevented and no lead build-up occurs on the surface of the barrel.

Figure 5:
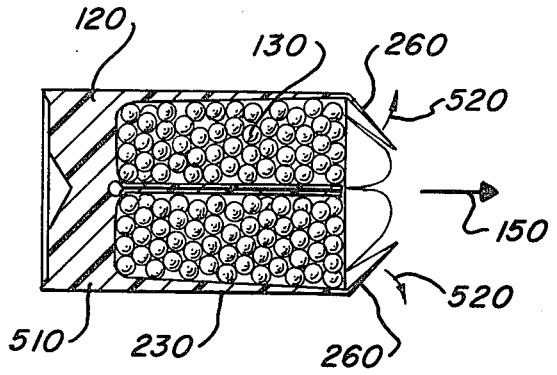
FIG. 5 is a cross-sectional view of the shot compressor of the present invention carrying the shot in the atmosphere just after leaving the barrel of the shotgun.

In FIG. 5, the shot compressor 120 and shot 130 are shown travelling in path 150 prior to the separation point 500 indicated in FIG. 1. The shot 130 and the shot compressor 120 have substantially the same momentum from the power source of the explosion 210. However, as the combination of the shot compressor 120 and the shot 130 travels along path 150 through the atmosphere towards separation point 500, the shot compressor 120 experiences drag along the outer cylindrical surface 510 of the wall 230. This drag slows the momentum of wall 120. As the momentum of the shot compressor slows, the shot having maintained the same momentum commences to push the flaps 260 upwardly in the direction of arrows 520.

Figure 6:
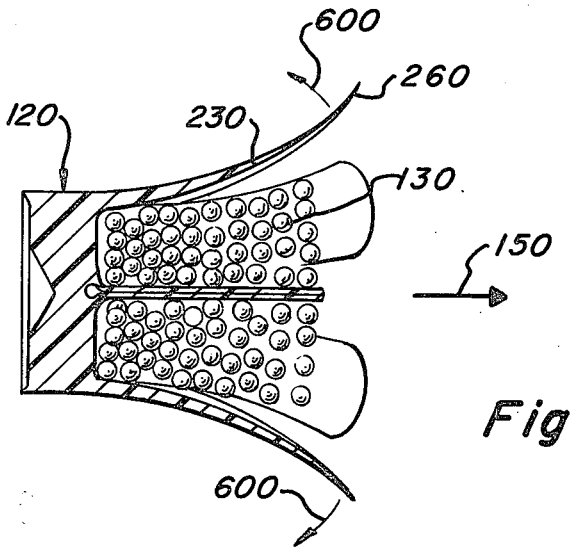
FIG. 6 is a cross-sectional view of the shot compressor expanding outwardly due to external pressures of the atmosphere.

As the flaps 260 continue opening in the direction of arrows 520, the incoming air suddenly catches onto the flaps 260 forcing them and the cylindrical wall 230 suddenly outwardly in the fashion shown in FIG. 6. The outer walls of the cylindrical shaped shot compressor are suddenly thrust in the direction of arrows 600 as illustrated in FIG. 6. The shot 130 continues in the direction of path 150 but is no longer encased by the shot compressor 120. The shot compressor 120, at this time, encounters still wind drag, much like a parachute opening up and quickly assumes the configuration shown in FIG. 7.

Figure 7:
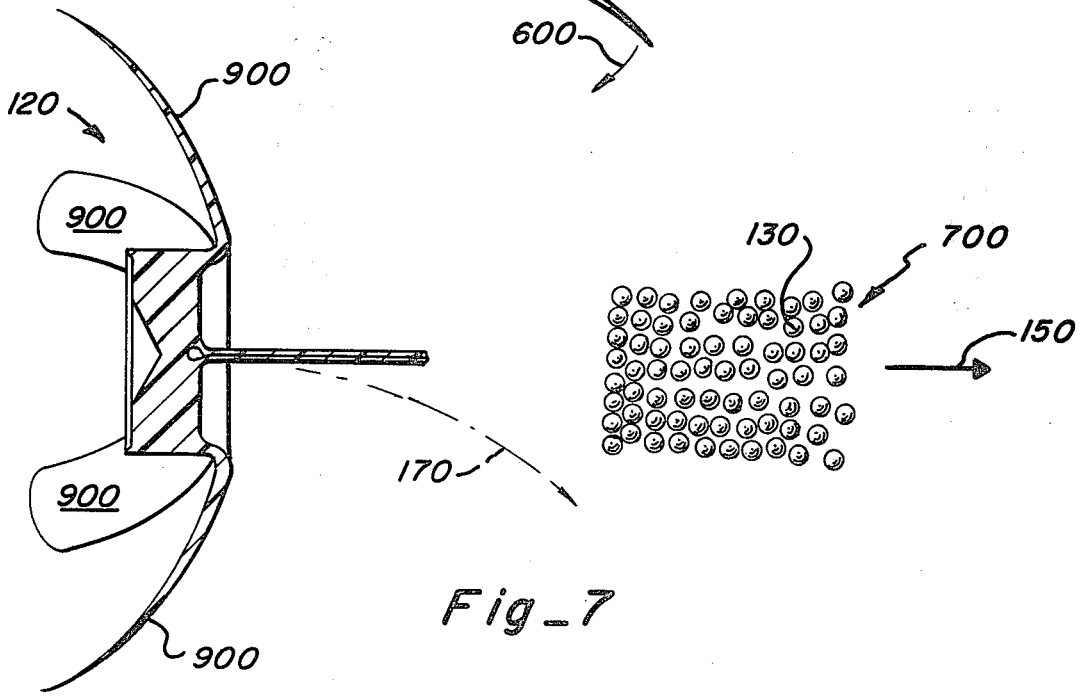
FIG. 7 is a cross-sectional view of the shot compressor of the present invention illustrating the separation of the wad from the steel shot in the atmosphere.

At the time interval of FIG. 7 which is represented by separation point 500 in FIG. 1, the shot 130 continues along trajectory 150 and is completely free of the shot compressor 120. The shot compressor 120 has it cylindrical outer side walls thrust rearwardly as shown in FIG. 7 and commences to drop toward the ground in the direction of trajectory 170. The front portions 700 of the shot 130 now engage stiff wind resistance and the shot commences to break apart in its flight towards the bird 160.

While the discussion of the events occurring in FIGS. 1–7 are believed to be occured by the inventor, it is to be expressely understood that no actual photographs of these occurences have been taken to verify the above analysis. However, it is to observed that the shot compressor as shown in FIG. 7, after firing, does have a collapsed center tube (which is sometimes broken apart) and its cylindrical side walls are pulled back rearwardly.

Figure 8:
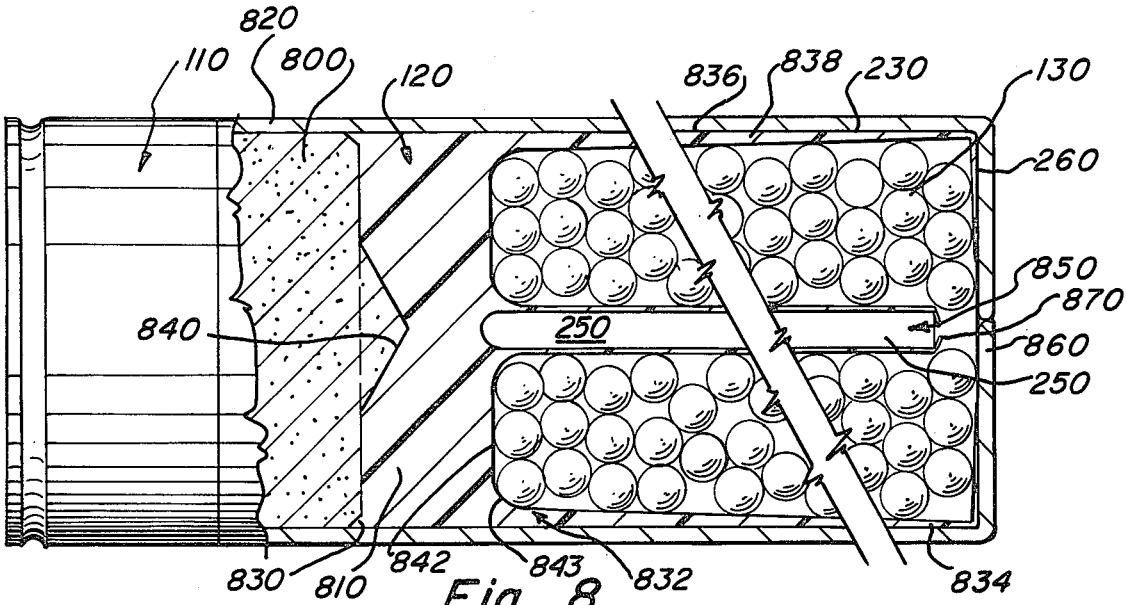
FIG. 8 is a partial cross-sectional view of the shotgun shell containing the shot compressor of the present invention.

In FIG. 8, the shot compressor 120 of the present invention is shown mounted into a shotgun shell 110. It is to be expressly understood that the shotgun shell 110 is conventional and may comprise any of a number of different constructions. The shot compressor 120 of one embodiment of the present invention is designed to retrofit into the interior of the shotgun shell 110 in the manner shown in FIG. 8. The bottom portion of the shot compressor 120 is designed to mount above the powder 800. The base 810 of the shot compressor 120 is of cylindrical shape whose diameter corresponds to the inner diameter of the side walls 820 of the shotgun shell 110. A rearward extending flange lip 830 is disposed on the outer perimeter of the base 810 and serves as a gas seal as shown in FIGS. 2 and 3 for the explosive force 210 of the exploding power 800. It is to be expressly understood that such a gas-seal shape is conventional in the art. Furthermore, also disposed in a conventional fashion in the base 810 of the shot compressor 120 is an indented cavity 840 having substantially triangular shaped cross-section. This cavity serves to concentrate the force of the explosion as shown in FIGS. 2 and 3, towards the center of the shot compressor 120 also in a conventional fashion.

The thickness of the base 810 of the shot compressor is about 0.3000 inch. The upstanding cylindrical side walls 230 of the shot compressor 120 have greater thickness at end 832 (about 0.045 to 0.050 inch) than at end 834 (about 0.028 to 0.032 inch). From end 832 and end 834 there is a gradual linear taper wherein the taper occurs on the inside of the shot compressor and not on the outside surface of the shot compressor. This is clearly shown in FIG. 8. The outer surface 836 of the cylindrical side walls 230, therefore, are of true cylindrical shape while the inner surface 838 of the cylindrical side wall 230 is of the shape of a cone. Therefore, the side walls 230 are co-extensive with the side of the base 810. Whereas, the inner surface 8383 of the side walls 230 encounters a first curved surface 840 and merges into the top flat surface 842 of the base 810.

Centrally formed or mounted on the surface 842 of base 810 is the upstanding hollow cylindrical tube 250. In the embodiments shown in FIG. 8, the upstanding cylindrical tube 250 is of the same diameter throughout its entire length. Although a cylindrical tube is shown, other geometric shapes such as tubes having triangular, square, diamond, etc. cross-sections could be used. In addition, a solid soft plastic rod could be used or even a plurality of smaller diameter plastic tubes could be used. The preferred mode of the tube is shown in the Drawing, but it is to be expressly understood that any structural center which collapses through the inward force of the shot as the shot compressor travels through the barrel of the gun could be used including, but not limited to, those listed above. The tube terminates in an end 850 which is slightly below the end 860 of the shotgun shell 110. The upstanding tube 250 is centrally disposed on the base on bottom surface 810 and is positioned to be parallel to the side walls 230. As will be brought out in greater detail later, the end 850 of the tube 250 contains a plurality of formed flaps 870. These formed flaps 870 serve to prevent any shot 130 from entering the hollow portion of the post 250. The diameter of the walls of the post 250 is smaller than the diameter of the shot being used. For example, shot sizes may vary from 0.08 to 0.33 inches in diameter. The diameter of the tube is approximately 0.01 to 0.02 inches smaller in diameter than the shot being used.

Flaps 260, in a manner to be more fully discussed, extend at substantially right angles from the side walls 230 underneath the end 860 of the shotgun shell 110. In loading, the flaps 860 of the shotgun shell 110 are upright and the shot compressor 120 of the present invention is inserted into the interior of the shell above the powder 800, firmly abutting thereagainst. Shot 130 is then placed around the center post 250 on the interior of the shot compressor 120 between the post 250 and the surface 838 of the side walls 230. The flaps 260 are then folded inwardly and the end 860 of the shotgun shell 110 is crimped into place. The shotgun shell is now ready to fire incorporating the shot compressor 120 of the present invention.

Figure 9:
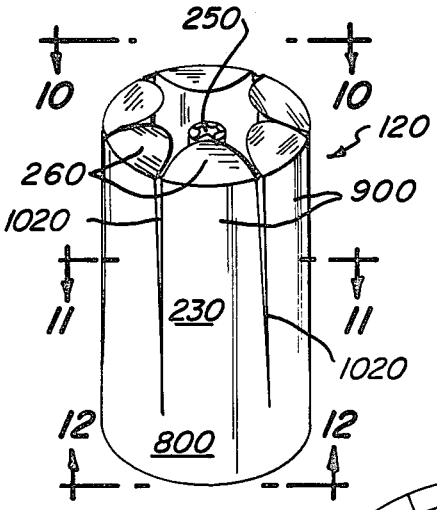
FIG. 9 is a perspective view of the shot compressor of the present invention.

Details of the construction of this embodiment of the shot compressor 120 of the present invention will now be discussed with reference to FIGS. 9–12. In FIG. 9, the shot compressor 120 standing alone is shown in perspective view to illustrate the base portion 800 being co-extensive with the cylindrical side walls 230 and the side walls 230 being further integral with flaps 260.

Figure 11:
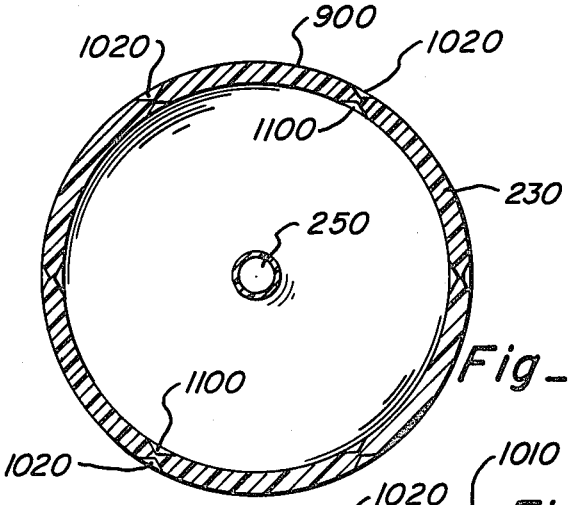
FIG. 11 is a mid cross-sectional view of the shot compressor of the present invention as shown in FIG. 9.
Figure 10:
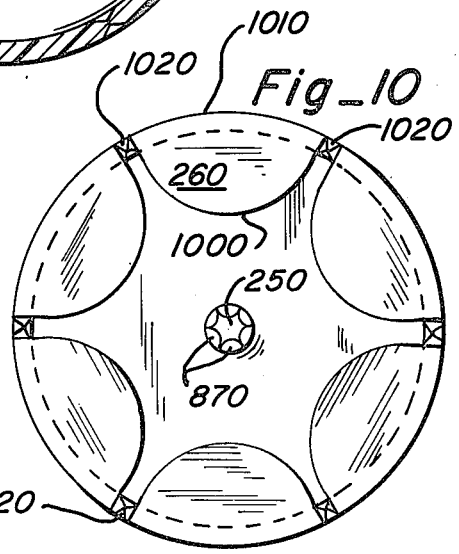
FIG. 10 is a top planar view of the shot compressor of the present invention.

By reference to FIG. 10, it is seen that each flap comprises an arcuate shaped end 1000. In the embodiment shown in FIG. 10, six flaps are shown. It is to be expressly understood that four or eight or any number of flaps can be positioned around the perimeter 1010 of the side walls 230. Each flap 260 engages the top end of the side wall 230. However, between each flap and the next flap 260, at point 1020, the side wall is of reduced thickness as best shown in FIG. 11. The thickness of the side wall is reduced at channel 1020 in order that each flap and corresponding side wall member 230 can be separated for rearward travel as shown in FIG. 7. Thus, the side wall 230 is capable of separating into a plurality of segments identified as 900. In FIG. 11, the segment 900 of base wall 230 is about 0.045 to 0.050 inches in thickness and the thickness of the membrance 1100 at the formed channel 1020 is about 0.005 to 0.010 inches thick. There is a gradual tapering from the larger thickness to the smaller thickness as shown in FIG. 11. Furthermore, the width of the channel 1020 as shown in FIG. 9 varies from a maximum at the end nearest the flap 260 to a minimum at the bottom 800.

Also shown in FIG. 10 is the top of the cylindrical tube 250 which is also shown to comprise or include a plurality of flaps 870 also of similar arcuate shape and configuration to flaps 260. However, there are no portions of reduced thickness in tube 250 corresponding to slits or reduced portions 1100 of FIG. 11. As mentioned previously, the purpose of flaps 870 is to prevent shot from falling down into the interior of tube 250. Other structural arrangements, such as other geometric shapes, can be used.

Figure 12:
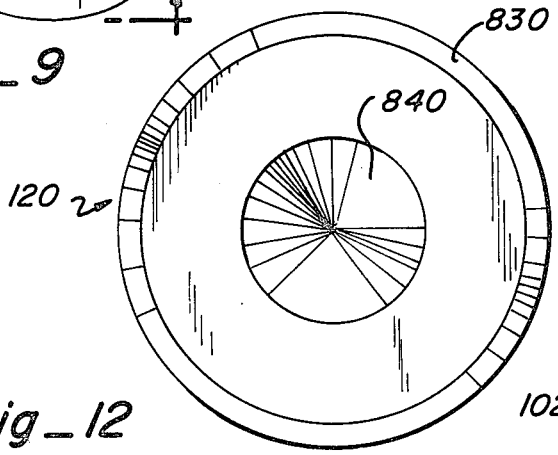
FIG. 12 is a bottom planar view of the shot compressor of the present invention as shown in FIG. 9.

In FIG. 12 is shown the bottom plan view of the shot compressor 120 of the present invention. This includes the sealing ring 830 and the conical shaped cavity 840.

Figure 4:
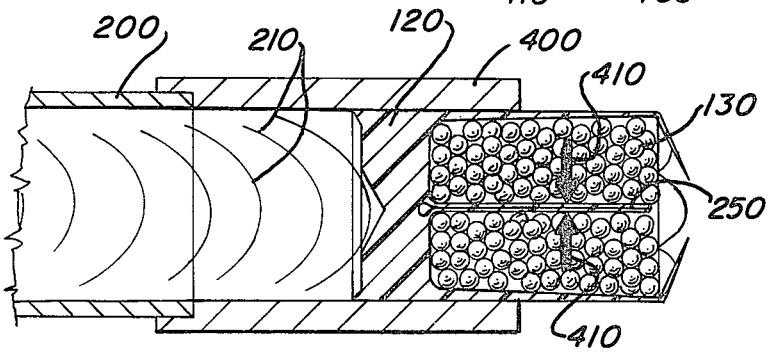
FIG. 4 is a cross-sectional view of the shot compressor of the present invention as it leaves the choke area of the shotgun and enters the atmosphere.

In FIGS. 13–17 is illustrated another embodiment of the principle espoused above which primarily relates to reloading situations. In this concept, two components may be separately utilized or in combination with each other. The first component is a collar portion 1300 which functions to retain the shot from spilling forward as shown in FIGS. 2, 3 and 4 by flap 260 and a second portion 1310 which servce to provide a hollow upstanding tube corresponding in principle to the tube 250 previously discussed.

Figure 13:
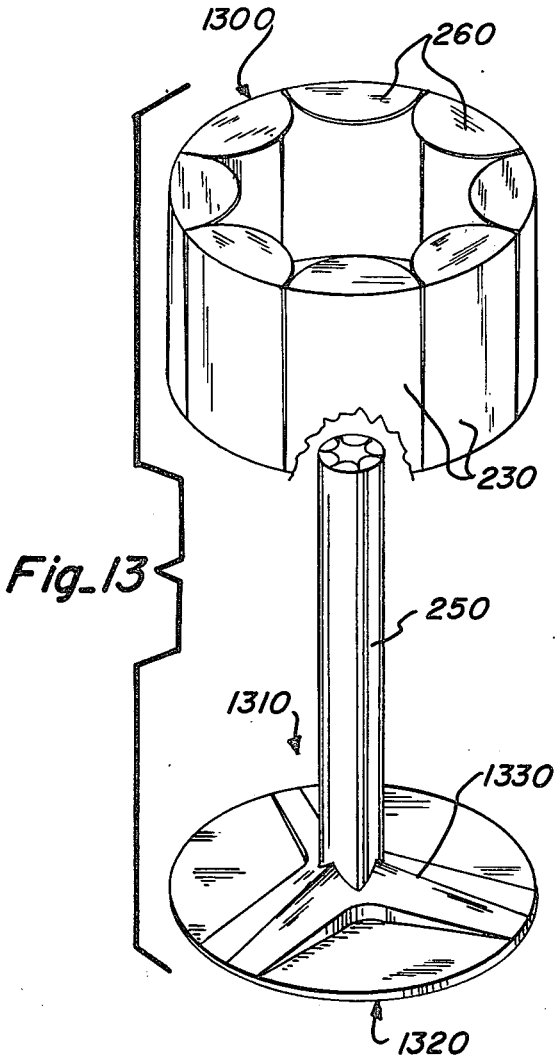
FIG. 13 is a perspective view of the collar and tube portion of the present invention.
Figure 14:
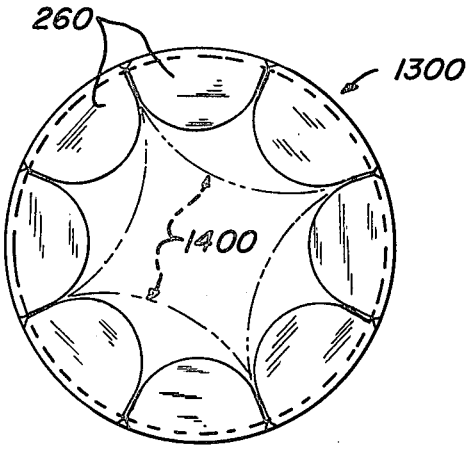
FIG. 14 is a top planar view of the collar and tube portion of FIG. 13.

The collar 1300, shown in FIG. 13, is of the same general configuration and shape as the upper portion of shot compressor 120 shown in FIG. 9, having eight flaps 260 rather than six flaps 260. The side walls 230, however, only go down a predetermined distance which is in the typical case, one-third the height. A top view of the collar is shown in FIG. 14 and the provision of four flaps are shown by dotted lines 1400. As mentioned previously, the number of flaps can be any suitable number, preferably four, six, or eight. It is to be expressly understood that the collar could be used without the tube in conjunction, for example, lead shot to prevent lead build-up on the inner surface of the barrel. It may also be used with steel shot cartridges to reduce barrel abrasion.

Figure 16:
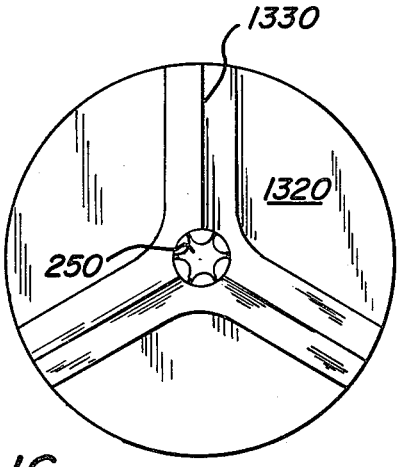
FIG. 16 is a top planar view of the tube portion of FIG. 13.
Figure 18:
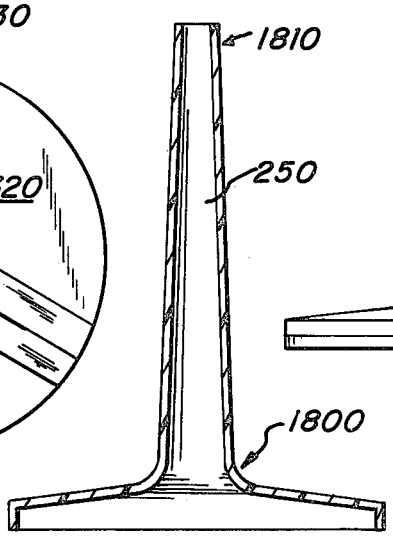
FIG. 18 is a cross-sectional view of a central tube having tapering edges.
Figure 17:
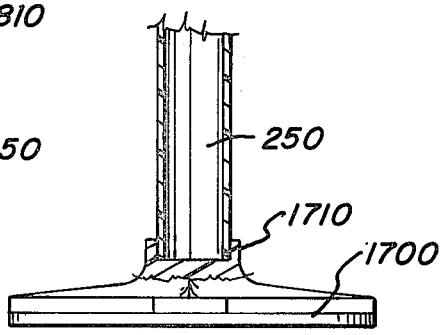
FIG. 17 is a partial cross-sectional view of a releasable center tube.

The tube portion 1310 shown in FIG. 13 is further detailed in FIGS. 16–18. The portion 1310 has the upstanding center tube 250 as in the above dicussion.

However, the base portion terminates in a circular disc base 1320. The underneath of base 1320 corresponds to that shown conventionally in FIG. 8 to include the sealing surface 820 and the force directing conical surface 840. To provide strength and rigidity, tapered support legs 1330 are further provided which adds structural strength to the configuration. The tube 250, the leg member 1330, and the circular base 1320 are of integral construction as shown in FIG. 13. It is to be expressly understood that various embodiments may be used including but not limited to a tube portion 1310 having no circular base 1320, but only having extending ribs 1330 of any number (three, four, etc.). Details of this portion 1310 from a top view are shown in FIG. 16.

Two embodiments are shown in FIGS. 17 and 18 of the tube construction which are different from that shown in FIG. 13. The first embodiment, the cylindrical tube 250 being of separate construction than the base 1700, is in releasable engagement with the base. The base 1700 is as shown in FIG. 13, but an upstanding collar 1710 is formed. The tube 250 is formed from a straw or similar device and press fits into the collar region 1710.

Yet another embodiment of the tube is shown in FIG. 18 to be of substantially tapered shape. All other tubes 250 discussed above have been of uniform diameter from one end to the other end. In this embodiment, the diameter of the tube 250 at the bottom end 1800 is larger than the diameter at the upper end, 1810 not shown. This particular configuration reduces the cost of manufacture since the formation of the flaps 870 at the end of the tube 250 are eliminated. Of course, the tube could also be of larger diameter at its upper end than the lower end, in which case, the flaps or similar obstruction would have to be used.

It is to be expressly understood that the tube with or without a base could be used with a conventional cartridge. The tube is substantially centered in the shot in order to provide compression as previously discussed.

Figure 15:
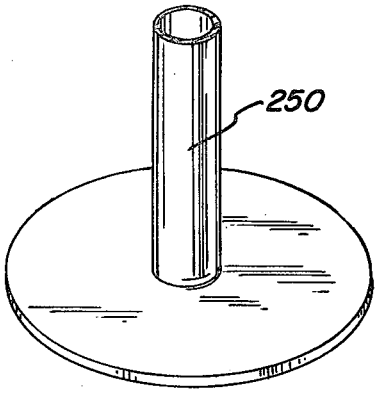
FIG. 15 is a perspective view of another embodiment of the tube portion of the present invention.

Yet another type of base is shown in FIG. 15 which is a solid round base with no support ribs whatsoever. The hollow tube 250 is upstanding therefrom.

The primary use of the embodiments shown in FIGS. 13–18 is found in reloading shotgun shells using conventional shot compressors. In other words, the hunter can buy conventional shot compressors and reload, using the collar 1300 and the tube portion 1310, with steel shot.

Although the present invention has been described with a certain decree of particularity, it is understood that the present disclosure has been made by way of example and that changes in details of structure may be made without departing from the spirit thereof.

I claim:

1. A shot compressor for use in a shotgun cartridge containing shot, said shot compressor comprising means centrally disposed internally of said cartridge with said shot disposed therearound for substantially fully and permanently collapsing a predetermined volume as said cartridge travels through the barrel of said shotgun upon firing of said cartridge, said collapsing means directing the shot radially inwardly towards said collapsing means while traveling through said barrel and immediately after exiting said barrel thereby minimizing barrel abrasion, shot deformation, and dispersion of shot.

2. A shot compressor for use in a shotgun cartridge containing shot, said shot compressor comprising means centrally disposed internally of said cartridge with said shot disposed therearound for substantially fully and permanently collapsing a predetermined volume as said cartridge travels through the barrel of said shotgun upon firing of said cartridge, said collapsing means directing the shot radially inwardly towards said collapsing means while traveling through said barrel and immediately after exiting said barrel thereby minimizing barrel abrasion, shot deformation, and dispersion of shot in which said collapsing means extends substantially the length of said disposed shot.

3. A shot compressor for use in a shotgun cartridge containing shot, said shot compressor comprising means centrally disposed internally of said cartridge with said shot disposed therearound for substantially fully and permanently collapsing a predetermined volume as said cartridge travels through the barrel of said shotgun upon firing of said cartridge, said collapsing means directing the shot radially inwardly towards said collapsing means while traveling through said barrel and immediately after exiting said barrel thereby minimizing barrel abrasion, shot deformation, and dispersion of shot in which said collapsing means extends substantially the length of said disposed shot and in which said collapsing means is cylindrical in shape having a diameter less than the diameter of an individual shot.

4. A shot compressor for use in a shotgun cartridge containing shot, said shot compressor comprising means centrally disposed internally of said cartridge with said shot disposed therearound for substantially fully and permanently collapsing a predetermined volume as said cartridge travels through the barrel of said shotgun upon firing of said cartridge, said collapsing means directing the shot radially inwardly towards said collapsing means while traveling through said barrel and immediately after exiting said barrel thereby minimizing barrel abrasion, shot deformation, and dispersion of shot in which said collapsing means forms a hollow central region.

5. A shot compressor for use in a shotgun cartridge containing shot, said shot compressor comprising means centrally disposed internally of said cartridge with said shot disposed therearound for substantially fully and permanently collapsing a predetermined volume as said cartridge travels through the barrel of said shotgun upon firing of said cartridge, said collapsing means directing the shot radially inwardly towards said collapsing means while traveling through said barrel and immediately after exiting said barrel thereby minimizing barrel abrasion, shot deformation, and dispersion of shot in which said collapsing means forms a hollow central region and means located on said collapsing means for preventing said shot from entering said hollow central region.

6. A shot compressor for use in a shotgun cartridge containing shot, said shot compressor comprising means centrally disposed internally of said cartridge with said shot uniformly disposed therearound for substantially fully and permanently collapsing a predetermined volume as said shot travels through the barrel of said shotgun after said cartridge is fired, said collapsing means being parallel to the sides of said cartridge and substantially extending the length of said shot disposed in said cartridge, said collapsing means directing the shot radially inwardly towards said collapsing means while traveling through said barrel and immediately after exiting said barrel thereby minimizing barrel abrasion, shot deformation, and dispersion of shot.

7. A shot compressor for use in a shotgun cartridge containing shot, said shot compressor comprising means centrally disposed internally of said cartridge with said shot uniformly disposed therearound for substantially fully and permanently collapsing a predetermined volume as said shot travels through the barrel of said shotgun after said cartridge is fired, said collapsing means being parallel to the sides of said cartridge and substantially extending the length of said shot disposed in said cartridge, said collapsing means directing the shot radially inwardly towards said collapsing means while traveling through said barrel and immediately after exiting said barrel thereby minimizing barrel abrasion, shot deformation, and dispersion of shot in which said collapsing means forms a hollow central region.

8. A shot compressor for use in a shotgun cartridge containing shot, said shot compressor comprising means centrally disposed internally of said cartridge with said shot uniformly disposed therearound for substantially fully and permanently collapsing a predetermined volume as said shot travels through the barrel of said shotgun after said cartridge is fired, said collapsing means being parallel to the sides of said cartridge and substantially extending the length of said shot disposed in said cartridge, said collapsing means directing the shot radially inwardly towards said collapsing means while traveling through said barrel and immediately after exiting said barrel thereby minimizing barrel abrasion, shot deformation, and dispersion of shot in which said collapsing means forms a hollow central region and further comprising means located on said collapsing means for preventing said shot from entering said hollow central region.

9. A shot compressor for use in a shotgun cartridge containing shot, said shot compressor comprising:

a bottom circular wall under said shot, an upstanding compressible hollow tube centrally disposed on said bottom wall, said shot being uniformly placed in the area defined around said tube, said tube permanently and fully collapsing a predetermined volume as said cartridge travels through the barrel of said shotgun after firing, and means on the end of said tube opposing said bottom wall for preventing said shot from entering the hollow portion of said tube.

10. A shot compressor for use in a shotgun cartridge containing shot, said compressor comprising:

means engaging said base and being centrally disposed internally of said cartridge with said shot uniformly disposed therearound for permanently and fully collapsing a predetermined volume as said shot travels through the barrel of said shotgun after said cartridge is fired, said collapsing means being parallel to the sides of said cartridge and substantially extending the length of said shot disposed therein, said collapsing means directing the shot radially inwardly towards said collapsing means while traveling through said barrel and immediately after exiting said barrel thereby minimizing barrel abrasion, shot deformation, and dispersion of shot, and a base engaging the bottom region of said cartridge below said shot.

11. The shot compressor of claim 10 in which said base comprises a plurality of radially extending legs, each of said legs extending outwardly from said base center.

12. The shot compressor of claim 11 in which said legs are mounted on a circular platform.

13. The shot compressor of claim 10 in which said base comprises a circular platform.

14. A shot compressor for use in a shotgun cartridge containing shot, said compressor comprising:

means engaging said base and being centrally disposed internally of said cartridge with said shot uniformly disposed therearound for permanently and fully collapsing a predetermined volume as said shot travels through the barrel of said shotgun after said cartridge is fired, said collapsing means being parallel to the sides of said cartridge and substantially extending the length of said shot disposed therein, said collapsing means directing the shot radially inwardly towards said collapsing means while traveling through said barrel and immediately after exiting said barrel thereby minimizing barrel abrasion, shot deformation, and dispersion of shot, and a base engaging the bottom region of said cartridge below said shot in which said collapsing means comprises a cylindrically-shaped hollow tube.

15. The shot compressor of claim 14 in which said hollow tube is selectively releasable from said base.

16. The shot compressor of claim 14 in which the end of said tube opposing said base comprises a means on said end for preventing said shot from entering the hollow portion of said tube.

17. A shot compressor for use in a shotgun cartridge containing shot, said compressor comprising:

a base for engaging the bottom region of said cartridge below said shot, said base comprising a plurality of radially extending legs supported on a circular platform, each of said legs extending outwardly from the center of said base, means engaging said base and being centrally disposed internally of said cartridge with said shot uniformly disposed therearound for permanently and fully collapsing a predetermined volume as said shot travels through the barrel of said shotgun after said cartridge is fired, said collapsing means being parallel to the sides of said cartridge and substantially extending the length of said shot disposed therein, said collapsing means directing the shot radially inwardly towards said collapsing means while traveling through said barrel and immediately after exiting said barrel thereby minimizing barrel abrasion, shot deformation, and dispersion of shot, and means on the end of said tube opposing said base for preventing said shot from entering the hollow portion of said tube.

18. A method for reducing barrel abrasion in a shotgun caused by steel shot travelling through the barrel of a shotgun and for increasing the range of steel shot, said method comprising the step of moving the steel shot in a radially inward direction towards a longitudinal center position for a predetermined amount as said steel shot travels through the barrel of the shotgun and immediately after said shot leaves said barrel.

* * * * *